US007283957B2

(12) United States Patent
Minde et al.

(10) Patent No.: US 7,283,957 B2
(45) Date of Patent: Oct. 16, 2007

(54) MULTI-CHANNEL SIGNAL ENCODING AND DECODING

(75) Inventors: Tor Björn Minde, Gammelstad (SE); Arne Steinarson, Sollentuna (SE); Jonas Svedberg, Luleå (SE); Tomas Lundberg, Luleå (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 971 days.

(21) Appl. No.: 10/380,423

(22) PCT Filed: Sep. 5, 2001

(86) PCT No.: PCT/SE01/01885

§ 371 (c)(1),
(2), (4) Date: Mar. 14, 2003

(87) PCT Pub. No.: WO02/23528

PCT Pub. Date: Mar. 21, 2002

(65) Prior Publication Data

US 2004/0109471 A1 Jun. 10, 2004

(30) Foreign Application Priority Data

Sep. 15, 2000 (SE) ..... 0003285

(51) Int. Cl.
*G10L 19/02* (2006.01)

(52) U.S. Cl. ..... 704/229; 704/223; 704/219; 704/262

(58) Field of Classification Search ..... 704/223, 704/205, 207, 229, 230, 220, 221, 219, 500–504, 704/262

See application file for complete search history.

(56) References Cited

U.S. PATENT DOCUMENTS

| | | | | |
|---|---|---|---|---|
| 5,684,923 | A | 11/1997 | Suzuki et al. | |
| 5,956,674 | A * | 9/1999 | Smyth et al. | 704/200.1 |
| 5,974,380 | A * | 10/1999 | Smyth et al. | 704/229 |
| 6,393,392 | B1 * | 5/2002 | Minde | 704/220 |

FOREIGN PATENT DOCUMENTS

| | | |
|---|---|---|
| DE | 198 29 284 | 11/1999 |
| EP | 0 858 067 | 8/1998 |
| EP | 0 875 999 | 11/1998 |
| WO | WO99/16136 | 12/1990 |
| WO | WO 00/19413 | 4/2000 |
| WO | WO 02/23528 | 3/2002 |

OTHER PUBLICATIONS

Gersho, "Advances in Speech and Audio Compression", Proceedings of the IEEE, vol. 82, No. 6, Jun. 1994, pp. 900-918.

(Continued)

*Primary Examiner*—Vijay Chawan
(74) *Attorney, Agent, or Firm*—Nixon & Vanderhye P.C.

(57) ABSTRACT

A multi-channel linear predictive analysis-by-synthesis signal encoding method detects (S26, S27) inter-channel correlation and select one of several possible encoding modes (S24, S29, S30) based on the detected correlation.

26 Claims, 8 Drawing Sheets

OTHER PUBLICATIONS

Spanias, "Speech Coding: A Tutorial Review", Proceedings of the IEEE, vol. 82, No. 10, Oct. 1994, pp. 1541-1582.
Gersho et al., "Variable Rate Speech Coding for Cellular Networks", Speech and audio coding for wireless and network applications, Kluwer Academic Press, 1993, pp. 77-84, .
Kleijn et.al, "Generalized analysis-by-synthesis coding and its application to pitch prediction", In Proc. IEEE Int. Conf. Acoust., Speech and Signal Processing, 1992, pp. 337-340.

* cited by examiner

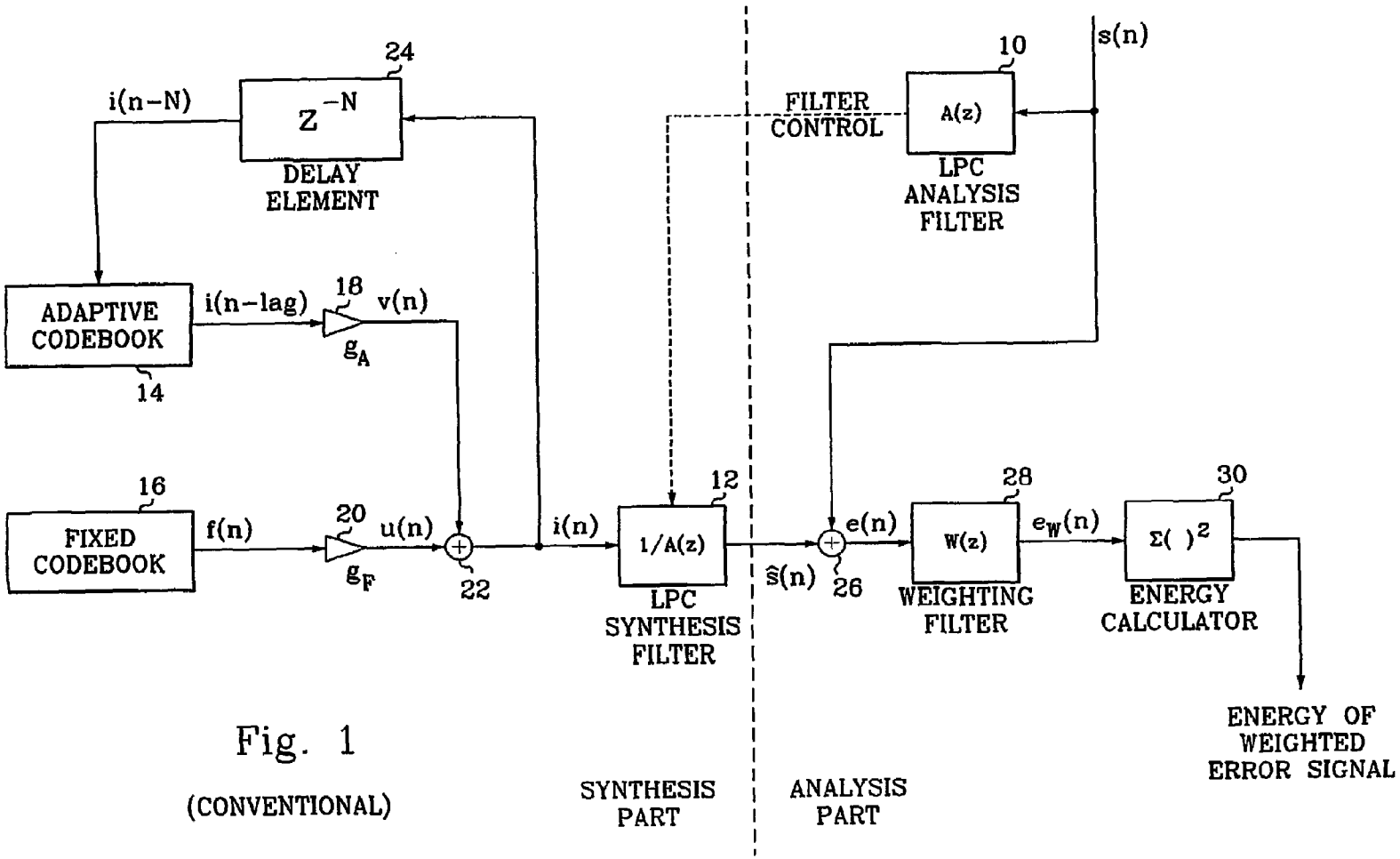
Fig. 1
(CONVENTIONAL)

MULTI-CHANNEL SIGNAL ENCODING AND DECODING

This application is the US national phase of international application PCT/SE01/01885 filed 5 Sep. 2001 which designated the U.S.

TECHNICAL FIELD

The present invention relates to encoding and decoding of multi-channel signals, such as stereo audio signals.

BACKGROUND OF THE INVENTION

Conventional speech coding methods are generally based on single-channel speech signals. An example is the speech coding used in a connection between a regular telephone and a cellular telephone. Speech coding is used on the radio link to reduce bandwidth usage on the frequency limited air-interface. Well known examples of speech coding are PCM (Pulse Code Modulation), ADPCM (Adaptive Differential Pulse Code Modulation), sub-band coding, transform coding, LPC (Linear Predictive Coding) vocoding, and hybrid coding, such as CELP (Code-Excited Linear Predictive) coding [1-2].

In an environment where the audio/voice communication uses more than one input signal, for example a computer workstation with stereo loudspeakers and two microphones (stereo microphones), two audio/voice channels are required to transmit the stereo signals. Another example of a multi-channel environment would be a conference room with two, three or four channel input/output. This type of applications is expected to be used on the Internet and in third generation cellular systems.

General principles for multi-channel linear predictive analysis-by-synthesis (LPAS) signal encoding/decoding are described in [3]. However, the described principles are not always optimal in situations where there is a strong variation in the correlation between different channels. For example, a multi-channel LPAS coder may be used with microphones that are at some distance apart or with directed microphones that are close together. In some settings, multiple sound sources will be common and inter-channel correlation reduced, while in other settings, a single sound will be predominant. Sometimes, the acoustic setting for each microphone will be similar, in other situations, some microphones may be close to reflective surfaces while others are not. The type and degree of inter-channel and intra-channel signal correlations in these different settings are likely to vary. The coder described in [3] is not always well suited to cope with these different cases.

SUMMARY OF THE INVENTION

An object to facilitate adaptation of multi-channel linear predictive analysis-by-synthesis signal encoding/decoding to varying inter-channel correlation.

The central problem is to find an efficient multi-channel LPAS speech coding structure that exploits the varying source signal correlation. For an M channel speech signal, we want a coder which can produce a bit-stream that is on average significantly below M times that of a single-channel speech coder, while preserving the same or better sound quality at a given average bit-rate.

Other objects include reasonable implementation and computational complexity for realizations of coders within this framework.

Objects are solved in accordance with the appended claims.

A coder can switch between multiple modes, so that encoding bits may be re-allocated between different parts of the multi-channel LPAS coder to best fit the type and degree of inter-channel correlation. This allows source signal controlled multi-mode multi-channel analysis-by-synthesis speech coding, which can be used to lower the bitrate on average and to maintain a high sound quality.

BRIEF DESCRIPTION OF THE DRAWINGS

FIG. 1 is a block diagram of a conventional single-channel LPAS speech encoder;

DETAILED DESCRIPTION

Figure 2:
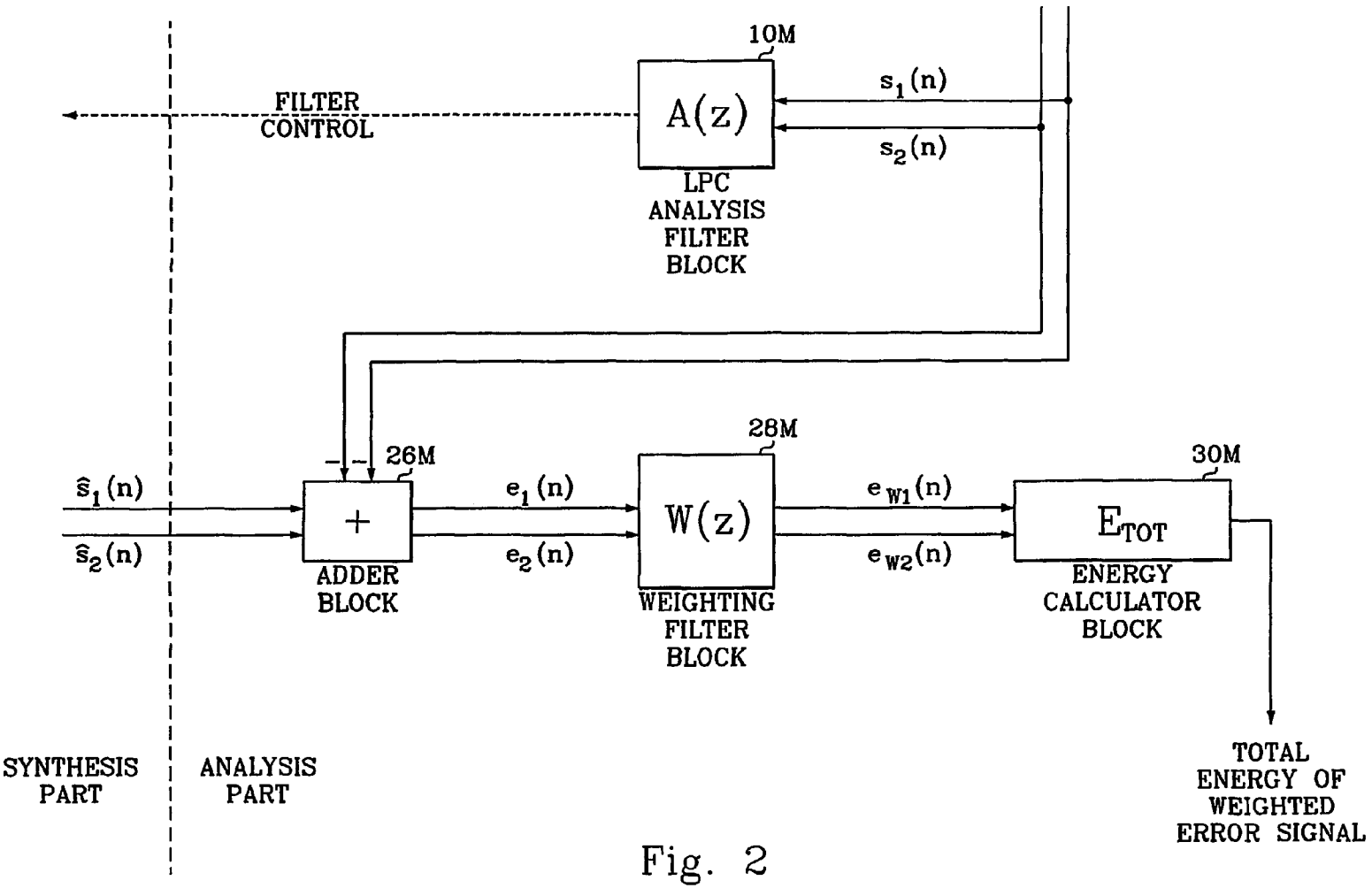
FIG. 2 is a block diagram of an embodiment of the analysis part of a prior art multi-channel LPAS speech encoder.

In the following description the same reference designations will be used for equivalent or similar elements.

A conventional single-channel linear predictive analysis-by-synthesis (LPAS) speech encoder, and a general multi-channel linear predictive analysis-by-synthesis speech encoder described in [3] are introduced.

FIG. 1 is a block diagram of a conventional single-channel LPAS speech encoder. The encoder comprises two parts, namely a synthesis part and an analysis part (a corresponding decoder will contain only a synthesis part).

The synthesis part comprises a LPC synthesis filter 12, which receives an excitation signal i(n) and outputs a synthetic speech signal $\hat{s}(n)$. Excitation signal i(n) is formed by adding two signals u(n) and v(n) in an adder 22. Signal u(n) is formed by scaling a signal f(n) from a fixed codebook 16 by a gain $g_F$ in a gain element 20. Signal v(n) is formed by scaling a delayed (by delay "lag") version of excitation signal i(n) from an adaptive codebook 14 by a gain $g_A$ in a gain element 18. The adaptive codebook is formed by a feedback loop including a delay element 24, which delays excitation signal i(n) one sub-frame length N. Thus, the adaptive codebook will contain past excitations i(n) that are shifted into the codebook (the oldest excitations are shifted out of the codebook and discarded). The LPC synthesis filter parameters are typically updated every 20-40 ms frame, while the adaptive codebook is updated every 5-10 ms sub-frame.

The analysis part of the LPAS encoder performs an LPC analysis of the incoming speech signal s(n) and also performs an excitation analysis.

The LPC analysis is performed by an LPC analysis filter 10. This filter receives the speech signal s(n) and builds a parametric model of this signal on a frame-by-frame basis. The model parameters are selected so as to minimize the energy of a residual vector formed by the difference between an actual speech frame vector and the corresponding signal vector produced by the model. The model parameters are represented by the filter coefficients of analysis filter 10. These filter coefficients define the transfer function A(z) of the filter. Since the synthesis filter 12 has a transfer function that is at least approximately equal to 1/A(z), these filter coefficients will also control synthesis filter 12, as indicated by the dashed control line.

The excitation analysis is performed to determine the best combination of fixed codebook vector (codebook index), gain $g_F$, adaptive codebook vector (lag) and gain $g_A$ that results in the synthetic signal vector $\{\hat{s}(n)\}$ that best matches speech signal vector $\{s(n)\}$ (here { } denotes a collection of samples forming a vector or frame). This is done in an exhaustive search that tests all possible combinations of these parameters (sub-optimal search schemes, in which some parameters are determined independently of the other parameters and then kept fixed during the search for the remaining parameters, are also possible). In order to test how close a synthetic vector $\{\hat{s}(n)\}$ is to the corresponding speech vector $\{s(n)\}$, the energy of the difference vector $\{e(n)\}$ (formed in an adder 26) may be calculated in an energy calculator 30. However, it is more efficient to consider the energy of a weighted error signal vector $\{e_w(n)\}$, in which the errors has been re-distributed in such a way that large errors are masked by large amplitude frequency bands. This is done in weighting filter 28.

The modification of the single-channel LPAS encoder of FIG. 1 to a multi-channel LPAS encoder in accordance with [3] will now be described with reference to FIGS. 2-3. A two-channel (stereo) speech signal will be assumed, but the same principles may also be used for more than two channels.

FIG. 2 is a block diagram of an embodiment of the analysis part of the multi-channel LPAS speech encoder described in [3]. In FIG. 2 the input signal is now a multi-channel signal, as indicated by signal components $s_1(n)$, $s_2(n)$. The LPC analysis filter 10 in FIG. 1 has been replaced by a LPC analysis filter block 10M having a matrix-valued transfer function A(z). Similarly, adder 26, weighting filter 28 and energy calculator 30 are replaced by corresponding multi-channel blocks 26M, 28M and 30M, respectively.

Figure 3:
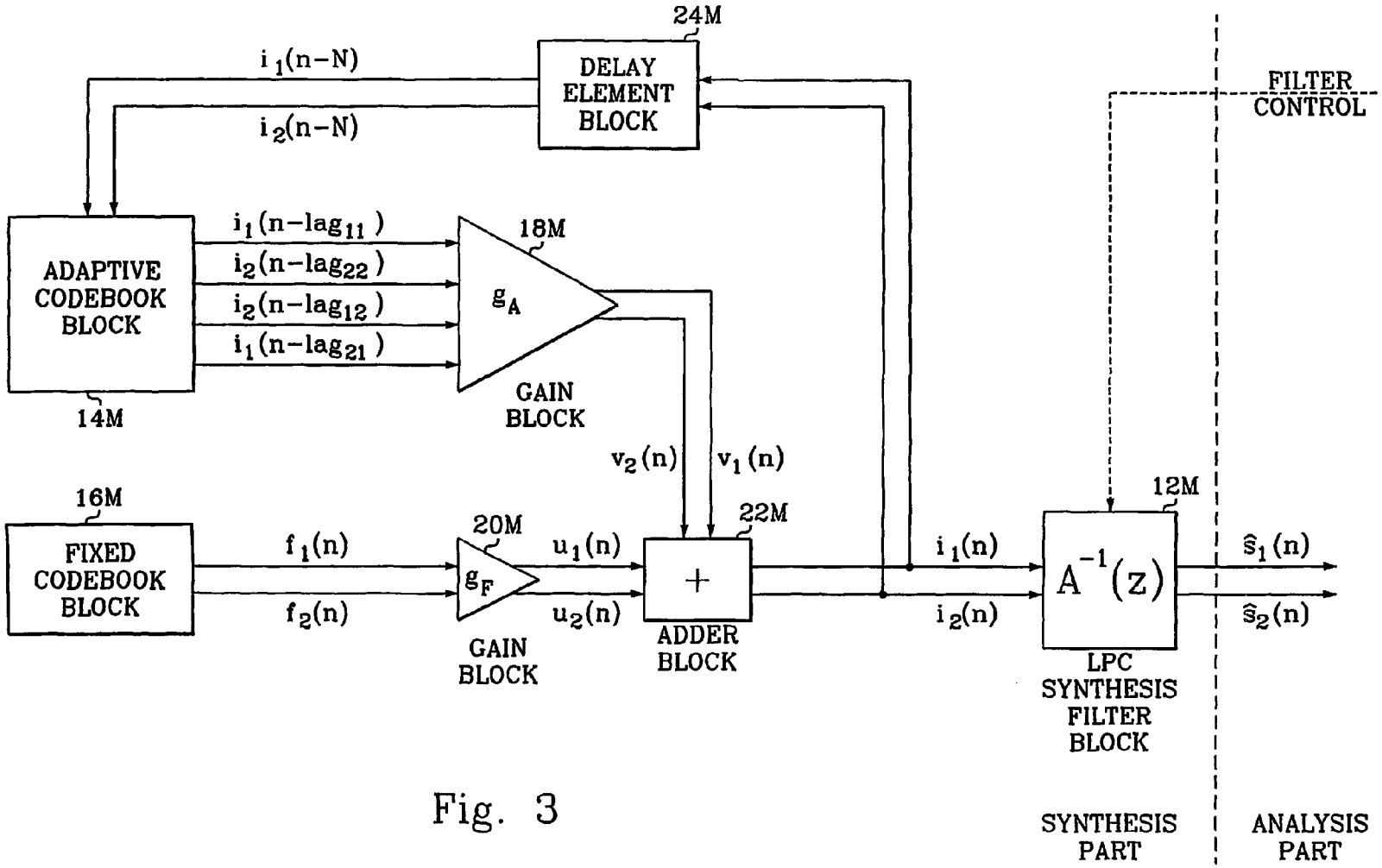
FIG. 3 is a block diagram of an embodiment of the synthesis part of a prior art multi-channel LPAS speech encoder.

FIG. 3 is a block diagram of an embodiment of the synthesis part of the multi-channel LPAS speech encoder described in [3]. A multi-channel decoder may also be formed by such a synthesis part. Here LPC synthesis filter 12 in FIG. 1 has been replaced by a LPC synthesis filter block 12M having a matrix-valued transfer function $A^{-1}(z)$, which is (as indicated by the notation) at least approximately equal to the inverse of A(z). Similarly, adder 22, fixed codebook 16, gain element 20, delay element 24, adaptive codebook 14 and gain element 18 are replaced by corresponding multi-channel blocks 22M, 16M, 24M, 14M and 18M, respectively.

A problem with this prior art multi-channel encoder is that it is not very flexible with regard to varying inter-channel correlation due to varying microphone environments. For example, in some situations several microphones may pick up speech from a single speaker. In such a case the signals from the different microphones may essentially be formed by delayed and scaled versions of the same signal, i.e. the channels are strongly correlated. In other situations there may be different simultaneous speakers at the individual microphones. In this case there is almost no inter-channel correlation. Sometimes, the acoustic setting for each microphone will be similar, in other situations, some microphones may be close to reflective surfaces while others are not. The type and degree of inter-channel and intra-channel signal correlations in these different settings are likely to vary. This motivates coders that can switch between multiple modes, so that bits may be re-allocated between different parts of the multi-channel LPAS coder to best fit the type and degree of inter-channel correlation. A fixed quality threshold and time varying signal properties (single speaker, multiple speakers, presence or absence of background noise, . . . etc) motivates multi-channel CELP coders with variable gross bit-rates. A fixed gross bit-rate can also be used where the bits are only re-allocated to improve coding and the perceived end-user quality.

The following description of a multi-mode multi-channel LPAS coder will describe how the coding flexibility in the various blocks may be increased. However, it is to be understood that not all blocks have to be configured in the described way. The exact balance between coding flexibility and complexity has to be decided for the individual coder implementation.

Figure 4:
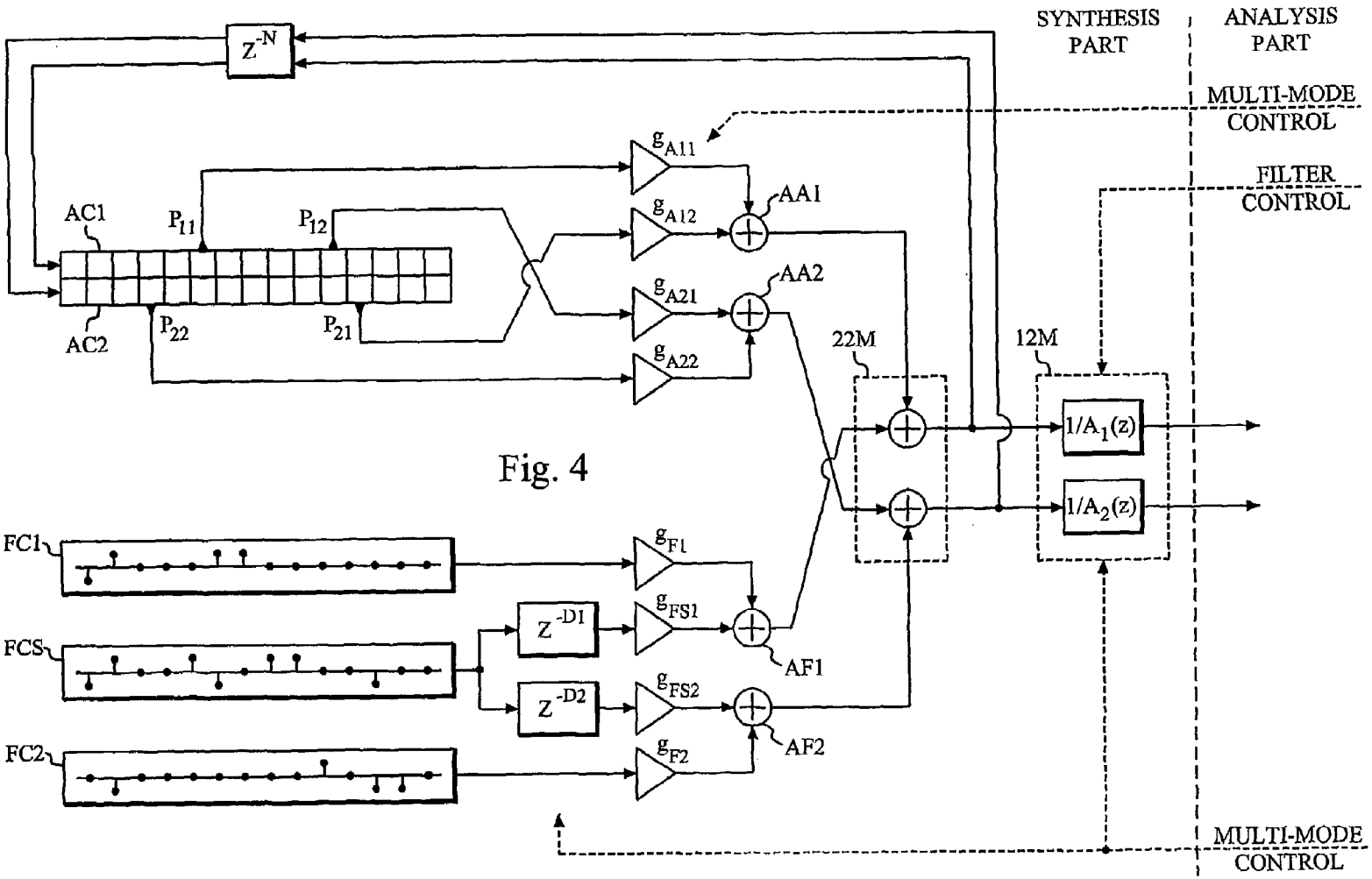
FIG. 4 is a block diagram of an exemplary embodiment of the synthesis part of a multi-channel LPAS speech encoder in accordance with the present invention.

FIG. 4 is a block diagram of an exemplary embodiment of the synthesis part of a multi-channel LPAS speech encoder.

One feature of the coder is the structure of the multi-part fixed codebook which includes both individual fixed codebooks FC1, FC2 for each channel and a shared fixed codebook FCS. Although the shared fixed codebook FCS is common to all channels (which means that the same codebook index is used by all channels), the channels are associated with individual lags D1, D2, as illustrated in FIG. 4. Furthermore, the individual fixed codebooks FC1, FC2 are associated with individual gains $g_{F1}$, $g_{F2}$, while the individual lags D1, D2 (which may be either integer or fractional) are associated with individual gains $g_{FS1}$, $g_{FS2}$. The excitation from each individual fixed codebook FS1, FS2 is added to the corresponding excitation (a common codebook vector, but individual lags and gains for each channel) from the shared fixed codebook FCS in an adder AF1, AF2. Typically the fixed codebooks comprise algebraic codebooks, in which the excitation vectors are formed by unit pulses that are distributed over each vector in accordance with certain rules (this is well known in the art and will not be described in further detail here).

This multi-part fixed codebook structure is very flexible. For example, some coders may use more bits in the individual fixed codebooks, while other coders may use more bits in the shared fixed codebook. Furthermore, a coder may dynamically change the distribution of bits between individual and shared codebooks, depending on the inter-channel correlation. In the ideal case where each channel consists of a scaled and translated version of the same signal (echo-free room), only the shared codebook is needed, and the lag values corresponds directly to sound propagation time. In the opposite case, where inter-channel correlation is very low, only separate fixed codebooks are required. For some signals it may even be appropriate to allocate more bits to one individual channel than to the other channels (asymmetric distribution of bits).

Although FIG. 4 illustrates a two-channel fixed codebook structure, it is appreciated that the concepts are easily generalized to more channels by increasing the number of individual codebooks and the number of lags and inter-channel gains.

The shared and individual fixed codebooks are typically searched in serial order. The preferred order is to first determine the shared fixed codebook excitation vector, lags and gains. Thereafter the individual fixed codebook vectors and gains are determined.

Two multi-part fixed codebook search methods will now be described with reference to FIGS. 5 and 6.

Figure 5:
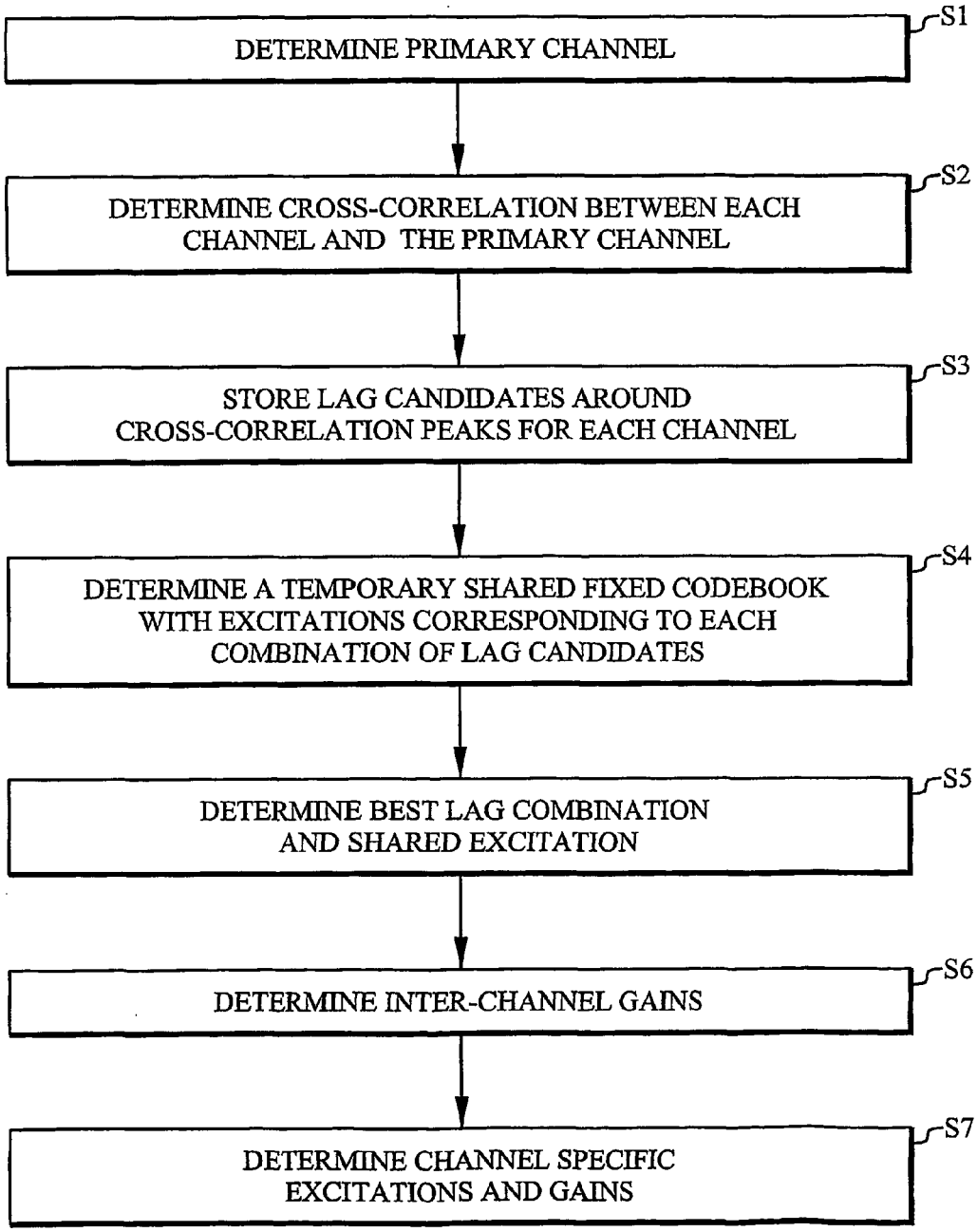
FIG. 5 is a flow chart of an exemplary embodiment of a multi-part fixed codebook search method.

FIG. 5 is a flow chart of an embodiment of a multi-part fixed codebook search method. Step S1 determines a primary or leading channel, typically the strongest channel (the channel that has the largest frame energy). Step S2 determines the cross-correlation between each secondary or lagging channel and the primary channel for a predetermined interval, for example a part of or a complete frame. Step S3 stores lag candidates for each secondary channel. These lag candidates are defined by the positions of a number of the highest cross-correlation peaks and the closest positions around each peak for each secondary channel. One could for instance choose the 3 highest peaks, and then add the closest positions on both sides of each peak, giving a total of 9 lag candidates. If high-resolution (fractional) lags are used the number of candidates around each peak may be increased to, for example, 5 or 7. The higher resolution may be obtained by up-sampling of the input signal. The lag for the primary channel may in a simple embodiment be considered to be zero. However, since the pulses in the codebook typically can not have arbitrary positions, a certain coding gain may be achieved by assigning a lag also to the primary channel. This is especially the case when high-resolution lags are used. In step S4 a temporary shared fixed codebook vector is formed for each stored lag candidate combination. Step S5 selects the lag combination that corresponds to the best temporary codebook vector. Step S6 determines the optimum inter-channel gains. Finally step S7 determines the channel specific (non-shared) excitations and gains.

In a variation of this algorithm all of or the best temporary codebook vectors and corresponding lags and inter-channel gains are retained. For each retained combination a channel specific search in accordance with step S7 is performed. Finally, the best combination of shared and individual fixed codebook excitation is selected.

In order to reduce the complexity of this method, it is possible to restrict the excitation vector of the temporary codebook to only a few pulses. For example, in the GSM system the complete fixed codebook of an enhanced full rate channel includes 10 pulses. In this case 3-5 temporary codebook pulses is reasonable. In general 25-50% of the total number of pulses would be a reasonable number. When the best lag combination has been selected, the complete codebook is searched only for this combination (typically the already positioned pulses are unchanged, only the remaining pulses of a complete codebook have to be positioned).

Figure 6:
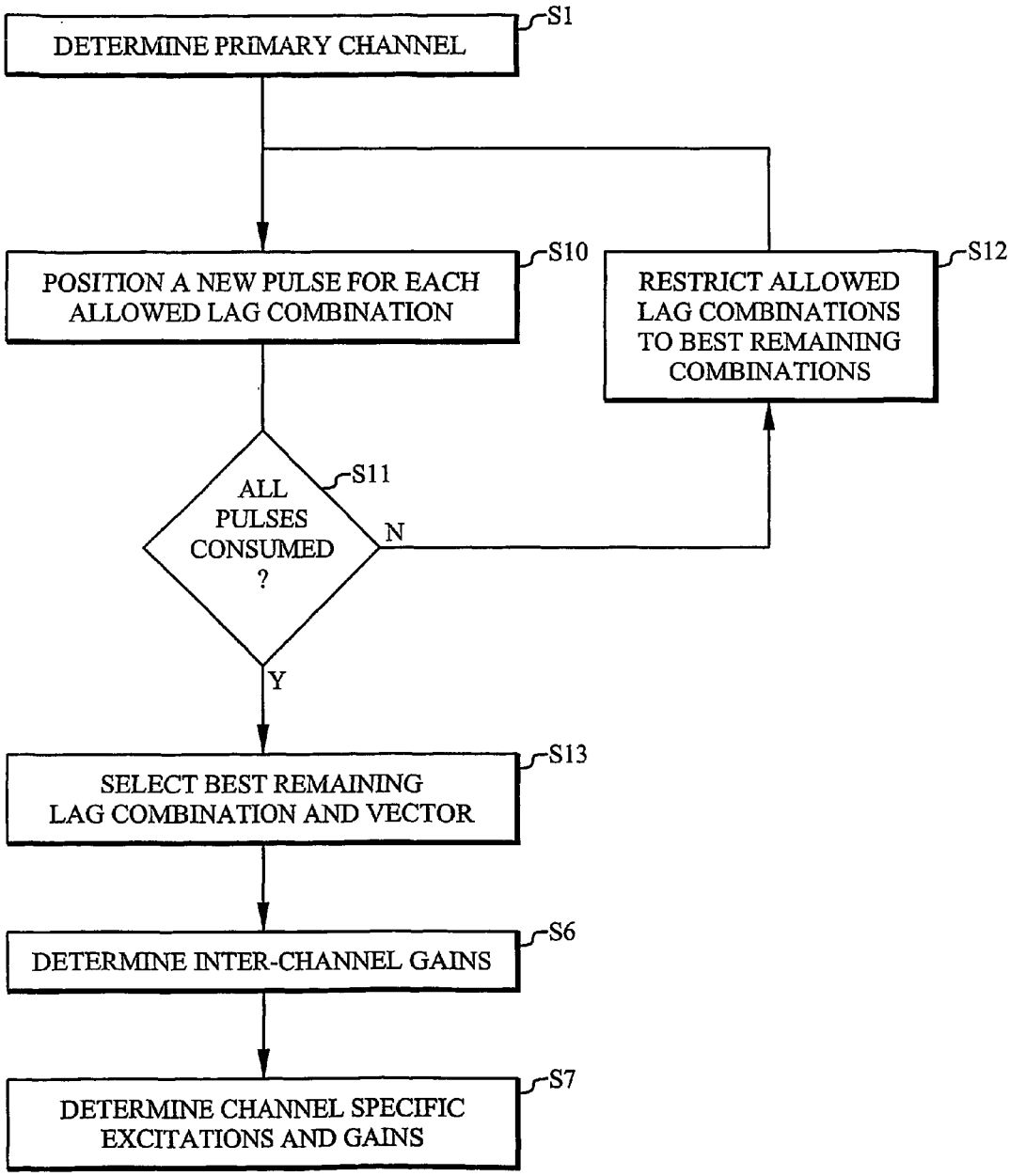
FIG. 6 is a flow chart of another exemplary embodiment of a multi-part fixed codebook search method.

FIG. 6 is a flow chart of another embodiment of a multi-part fixed codebook search method. In this embodiment steps S1, S6 and S7 are the same as in the embodiment of FIG. 5. Step S10 positions a new excitation vector pulse in an optimum position for each allowed lag combination (the first time this step is performed all lag combinations are allowed). Step S11 tests whether all pulses have been consumed. If not, step S12 restricts the allowed lag combinations to the best remaining combinations. Thereafter another pulse is added to the remaining allowed combinations. Finally, when all pulses have been consumed, step S13 selects the best remaining lag combination and its corresponding shared fixed codebook vector.

There are several possibilities with regard to step S12. One possibility is to retain only a certain percentage, for example 25%, of the best lag combinations in each iteration. However, in order to avoid that there only remains one combination before all pulses have been consumed, it is possible to ensure that at least a certain number of combinations remain after each iteration. One possibility is to make sure that there always remain at least as many combinations as there are pulses left plus one. In this way there will always be several candidate combinations to choose from in each iteration.

With only one cross-channel branch in the fixed codebook, the primary and secondary channel have to be determined frame-by-frame. A possibility here is to assign the fixed codebook part for the primary channel to use more pulses than for the secondary channel.

For the fixed codebook gains, each channel requires one gain for the shared fixed codebook and one gain for the individual codebook. These gains will typically have significant correlation between the channels. They will also be correlated to gains in the adaptive codebook. Thus, inter-channel predictions of these gains will be possible, and vector quantization may be used to encode them.

Returning to FIG. 4, the multi-part adaptive codebook includes one adaptive codebook AC1, AC2 for each channel. A multi-part adaptive codebook can be configured in a number of ways in a multi-channel coder.

One possibility is to let all channels share a common pitch lag. This is feasible when there is a strong inter-channel correlation. Even when the pitch lag is shared, the channels may still have separate pitch gains $g_{A11}$, $g_{A22}$. The shared pitch lag is searched in a closed loop fashion in all channels simultaneously.

Another possibility is to let each channel have an individual pitch lag $P_{11}$, $P_{22}$. This is feasible when there is a weak inter-channel correlation (the channels are independent). The pitch lags may be coded differentially or absolutely.

A further possibility is to use the excitation history in a cross-channel manner. For example, channel 2 may be predicted from the excitation history of channel 1 at inter-channel lag $P_{12}$. This is feasible when there is a strong inter-channel correlation.

As in the case with the fixed codebook, the described adaptive codebook structure is very flexible and suitable for multi-mode operation. The choice whether to use shared or individual pitch lags may be based on the residual signal energy. In a first step the residual energy of the optimal shared pitch lag is determined. In a second step the residual energy of the optimal individual pitch lags is determined. If the residual energy of the shared pitch lag case exceeds the residual energy of the individual pitch lag case by a predetermined amount, individual pitch lags are used. Otherwise a shared pitch lag is used. If desired, a moving average of the energy difference may be used to smoothen the decision.

This strategy may be considered as a "closed-loop" strategy to decide between shared or individual pitch lags. Another possibility is an "open-loop" strategy based on, for example, inter-channel correlation. In this case, a shared pitch lag is used if the inter-channel correlation exceeds a predetermined threshold. Otherwise individual pitch lags are used.

Similar strategies may be used to decide whether to use inter-channel pitch lags or not.

Furthermore, a significant correlation is to be expected between the adaptive codebook gains of different channels. These gains may be predicted from the internal gain history of the channel, from gains in the same frame but belonging to other channels, and also from fixed codebook gains. As in the case with the fixed codebook, vector quantization is also possible.

In LPC synthesis filter block 12M in FIG. 4 each channel uses an individual LPC (Linear Predictive Coding) filter. These filters may be derived independently in the same way as in the single channel case. However, some or all of the channels may also share the same LPC filter. This allows for switching between multiple and single filter modes depending on signal properties, e.g. spectral distances between LPC spectra. If inter-channel prediction is used for the LSP (Line Spectral Pairs) parameters, the prediction is turned off or reduced for low correlation modes.

Figure 7:
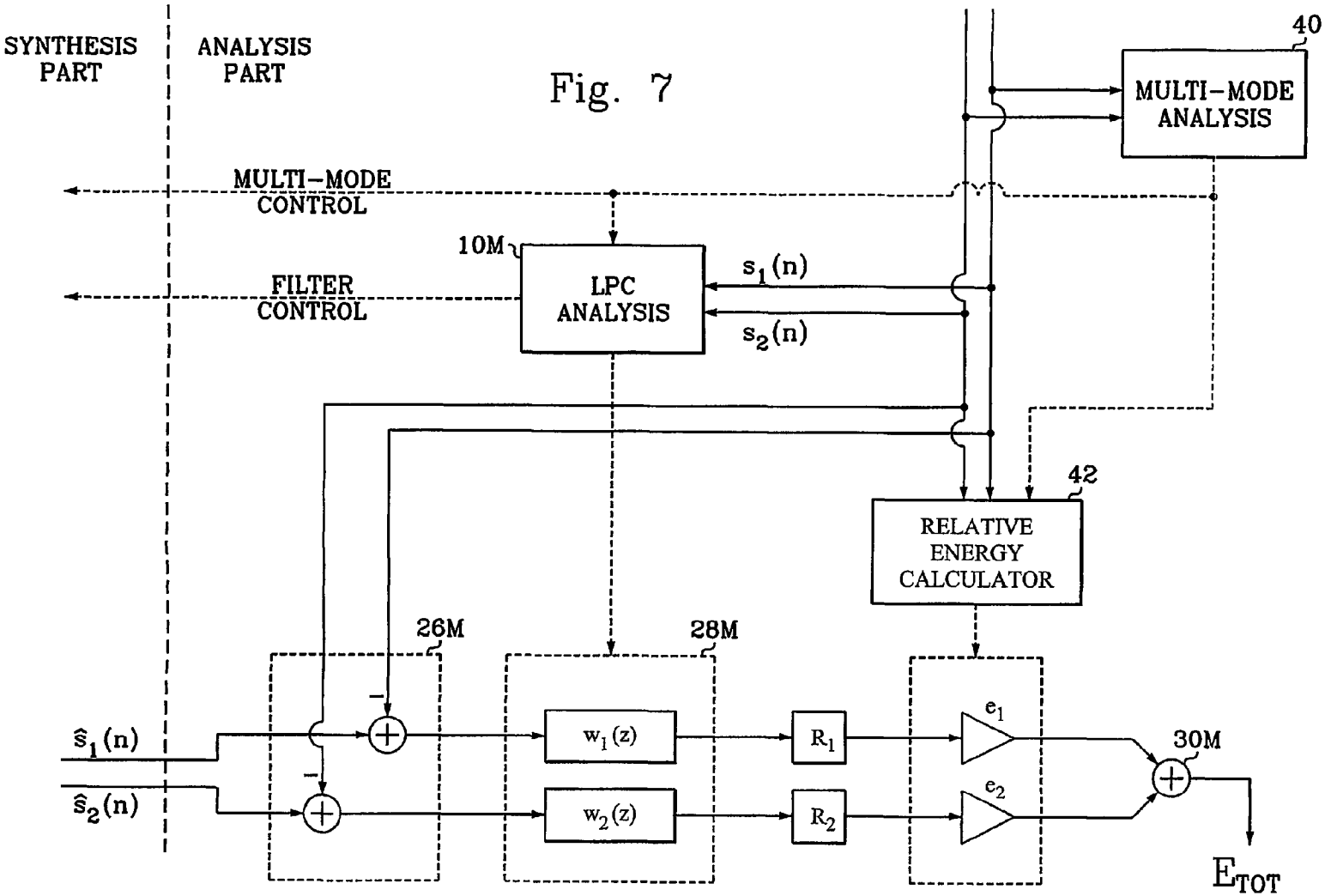
FIG. 7 is a block diagram of an exemplary embodiment of the analysis part of a multi-channel LPAS speech encoder in accordance with the present invention.

FIG. 7 is a block diagram of an example embodiment of the analysis part of a multi-channel LPAS speech encoder. In addition to the blocks that have already been described with reference to FIGS. 1 and 2, the analysis part in FIG. 7 includes a multi-mode analysis block 40. Block 40 determines the inter-channel correlation to determine whether there is enough correlation between the channels to justify encoding using only the shared fixed codebook FCS, lags D1, D2 and gains $g_{FS1}$, $g_{FS2}$. If not, it will be necessary to use the individual fixed codebooks FC1, FC2 and gains $g_{F1}$, $g_{F2}$. The correlation may be determined by the usual correlation in the time domain, i.e. by shifting the secondary channel signals with respect to the primary signal until a best fit is obtained. If there are more than two channels, a shared fixed codebook will be used if the smallest correlation value exceeds a predetermined threshold. Another possibility is to use a shared fixed codebook for the channels that have a correlation to the primary channel that exceeds a predetermined threshold and individual fixed codebooks for the remaining channels. The exact threshold may be determined by listening tests.

The analysis part may also include a relative energy calculator 42 that determines scale factors $e_1$, $e_2$ for each channel. These scale factors may be determined in accordance with:

$$e_i = \frac{E_i}{\sum_i E_i}$$

where $E_i$ is the energy of frame i. Using these scale factors, the weighted residual energy $R_1$, $R_2$ for each channel may be rescaled in accordance with the relative strength of the channel, as indicated in FIG. 7. Rescaling the residual energy for each channel has the effect of optimizing for the relative error in each channel rather than optimizing for the absolute error in each channel. Multi-channel error resealing may be used in all steps (deriving LPC filters, adaptive and fixed codebooks).

The scale factors may also be more general functions of the relative channel strength $e_i$, for example $$f(e_i) = \frac{\exp(\alpha(2e_i - 1))}{1 + \exp(\alpha(2e_i - 1))}$$

where $\alpha$ is a constant in he interval 4-7, for example $\alpha \approx 5$. The exact form of the scaling function may be determined by subjective listening tests.

The functionality of the various elements of the described embodiments of the present invention are typically implemented by one or several micro processors or micro/signal processor combinations and corresponding software.

In the figures several blocks and parameters are optional and can be used based on the characteristics of the multi-channel signal and on overall speech quality requirement. Bits in the coder can be allocated where they are best needed. On a frame-by-frame basis, the coder may choose to distribute bits between the LPC part, the adaptive and fixed codebook differently. This is a type of intra-channel multi-mode operation.

Another type of multi-mode operation is to distribute bits in the encoder between the channels (asymmetric coding). This is referred to as inter-channel multi-mode operation. An example here would be a larger fixed codebook for one/some of the channels or coder gains encoded with more bits in one channel. The two types of multi-mode operation can be combined to efficiently exploit the source signal characteristics.

In variable rate operation the overall coder bit-rate may change on a frame-to-frame basis. Segments with similar background noise in all channels will require fewer bits than say segment with a transition from unvoiced to voiced speech appearing at slightly different positions within multiple channels. In scenarios such as teleconferencing where multiple speakers may overlap each other, different sounds may dominate different channels for consecutive frames. This also motivates a momentarily increased higher bit-rate.

The multi-mode operation can be controlled in a closed-loop fashion or with an open-loop method. The closed loop method determines mode depending on a residual coding error for each mode. This is a computational expensive method. In an open-loop method the coding mode is determined by decisions based on input signal characteristics. In the intra-channel case the variable rate mode is determined based on for example voicing, spectral characteristics and signal energy as described in [4]. For inter-channel mode decisions the inter-channel cross-correlation function or a spectral distance function can be used to determine mode. For noise and unvoiced coding it is more relevant to use the multi-channel correlation properties in the frequency domain. A combination of open-loop and closed-loop techniques is also possible. The open-loop analysis decides on a few candidate modes, which are coded and then the final residual error is used in a closed-loop decision.

Inter-channel correlation will be stronger at lags that are related to differences in distance between sound sources and microphone positions. Such inter-channel lags are exploited in conjunction with the adaptive and fixed codebooks in the proposed multi-channel LPAS coder. For inter-channel multi-mode operation this feature will be turned off for low correlation modes and no bits are spent on inter-channel lags.

Multi-channel prediction and quantization may be used for high inter-channel correlation modes to reduce the number of bits required for the multi-channel LPAS gain and LPC parameters. For low inter-channel correlation modes less inter-channel prediction and quantization will be used. Only intra-channel prediction and quantization might be sufficient Multi-channel error weighting as described with reference to FIG. 7 could be turned on and off depending on the inter-channel correlation.

An example of an algorithm performed by block 40 for deciding coding strategy will be described below with reference to FIG. 8. However, first a number of explanations and assumptions will be given.

Multi-mode analysis block 40 may be operating in open loop or closed loop or on a combination of both principles. An open loop embodiment will analyze the incoming signals from the channels and decide upon a proper encoding strategy for the current frame and the proper error weighting and criteria to be used for the current frame.

In the following example the LPC parameter quantization is decided in an open loop fashion, while the final parameters of the adaptive codebook and the fixed codebook are determined in a closed loop fashion when voiced speech is to be encoded.

The error criterion for the fixed codebook search is varied according to the output of individual channel phonetic classification.

Assume that the phonetic classes for each channel are (VOICED, UN-VOICED, TRANSIENT, BACKGROUND), with the subclasses (VERY_NOISY, NOISY, CLEAN). The subclasses indicate whether the input signal is noisy or not, giving a reliability indication for the phonetic classification that also can be used to fine-tune the final error criteria.

If a frame in a channel is classified as a UNVOICED or BACKGROUND the fixed codebook error criterion is changed to an energy and frequency domain error criterion for that channel. For further information on phonetic classification see [4].

Assume that the LPC parameters can be encoded in two different ways:

1. One common set of LPC parameters for the frame.
2. Separate sets of LPC parameters for each channel.

The long term predictor (LTP) is implemented as an adaptive codebook.

Assume that the LTP-lag parameters can be encoded in different ways:

1. No LTP-lag parameters in either channel.
2. LTP lag-parameters only for channel 1.
3. LTP lag-parameters only for channel 2.
4. Separate LTP-lag-parameters for channel 1 and channel 2

The LTP-gain parameters are encoded separately for each lag parameter.

Assume that the fixed codebook parameters for a channel may encoded in five ways:

Separate small size codebook, (searched in the frequency domain for unvoiced/background noise coding).
Separate medium size codebook.
Separate large size codebook.
Common shared codebook
Common shared codebook and separate medium sized codebook The gains for each channel and codebook are encoded separately.

Figure 8:
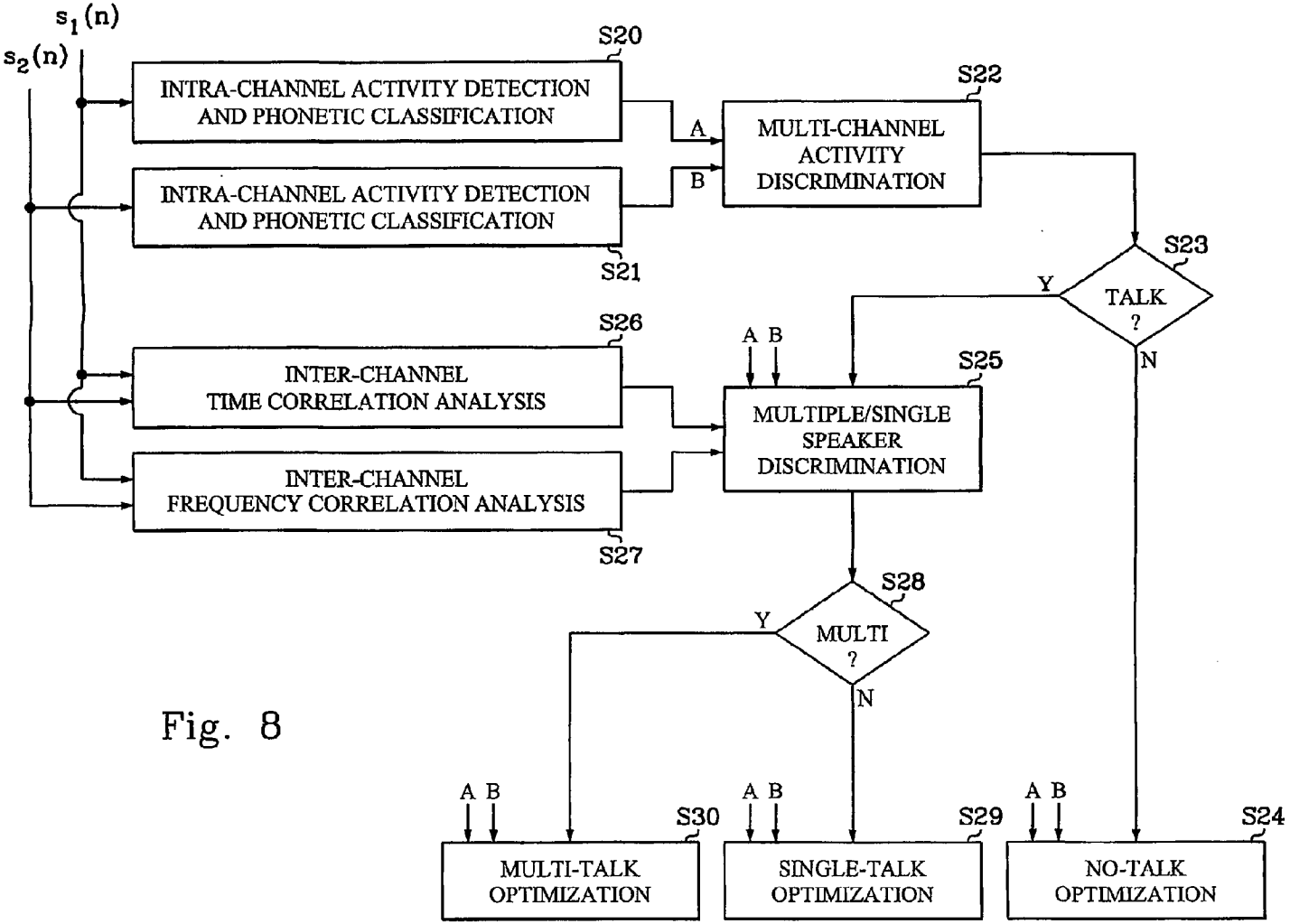
FIG. 8 is a flow chart illustrating an exemplary embodiment of a method for determining coding strategy.

FIG. 8 is a flow chart illustrating an exemplary embodiment of a method for determining coding strategy.

The multi-mode analysis makes a pre-classification of the multi-channel input into three main quantization strategies: (MULTI-TALK, SINGLE-TALK, NO-TALK). The flow is illustrated in FIG. 8.

To select the appropriate strategy each channel has its own intra-channel activity detection and intra-channel phonetic classification is steps S20, S21. If both of the phonetic classifications A, B indicate BACKGROUND, the output in multi-channel discrimination step S22 is NO-TALK, otherwise the output is TALK. Step S23 tests whether the output from step S22 indicates TALK. If this is not he case, the algorithm proceeds to step S24 to perform a no-talk strategy.

On the other hand if step S23 indicates TALK, the algorithm proceeds to step S25 to discriminate between a multi/single speaker situation. Two inter-channel properties are used in this example to make this decision in step S25, namely the inter-channel time correlation and the inter-channel frequency correlation.

The inter-channel time correlation value in this example is rectified and then thresholded (step S26) into two discrete values (LOW_TIME_CORR and HIGH_TIME_CORR).

The inter channel frequency correlation is implemented (step S27) by extracting a normalized spectral envelope for each channel and then summing up the rectified difference between the channels. The sum is then thresholded into two discrete values (LOW_FREQ_CORR and HIGH_FREQ_CORR), where LOW_FREQ_CORR is set if the sum of the rectified differences is greater than a threshold. (i.e. inter channel frequency correlation is estimated using as a straightforward spectral (envelope) difference measure). The Spectral difference can for example be calculated in the LSF domain or using the amplitudes from an N-Point FFT. (The spectral difference may also be frequency weighted to give larger importance to low frequency differences.)

In step S25, if both of the phonetic classifications (A,B) indicates VOICED and the HIGH_TIME_CORR is set, the output is SINGLE.

If both of the phonetic classifications (A,B) indicates UNVOICED and HIGH_FREQ_CORR is set, the output is SINGLE.

If one of the phonetic classifications (A,B) indicates VOICED and the previous output was SINGLE and the HIGH_TIME_CORR is set, the output remains at SINGLE.

Otherwise the output is MULTI.

Step S28 tests whether the output from step S25 is SINGLE or MULTI. If it is SINGLE, the algorithm proceeds to step S29 to perform a single-talk strategy. Otherwise it proceeds to step S30 to perform a multi-talk strategy.

The three strategies performed in steps S24, S29 and S30, respectively, will now be described. The abbreviations FCB and ACB are used for the fixed and adaptive codebook, respectively.

In step S24 (no-talk) there are two possibilities:

HIGH_FREQ_CORR:
Common bits used (low spectral distance)
LPC Low bit rate used
ACB Skipped if long term correlation is low.
FCB Very low bit rate code book used.

LOW_FREQ_CORR:
Separate bit allocations used (spectral distance is high) for each channel
LPC Low bit rate used
ACB Skipped if long term correlation is low.
FCB Very low bit rate code book used.

In step S29 (single-talk) the following strategy is used.

General: Common bits used if possible. Closed loop selection and phonetic classification is used to finalize the bit allocation.

LPC common

ACB Common or Separate

1. Channels classified as VOICED: ACBs selected in a closed Loop fashion for voiced frames, common ACB or two separate ACBs
2. One channel is classified as non-VOICED and the other VOICED: Separate ACBs for each channel.
3. None of the channels are classified as VOICED: ACB is then not used at all.

FCB Common or Separate:

1. If both channels are VOICED, a Common FCB is used.
2. If both channels are VOICED and at least one of the previous frames from each channel were non- VOICED, a common FCB plus two separate medium sized FCBs are used (This is an assumed startup-state).

3. If one of the channels are non-VOICED separate FCBs are used.

4. The size of the separate FCBs is controlled using the phonetic class for that channel.

Note: If one of the channels is classified into the background class, the other channel FCB is allowed to use most of the available bits, (i.e. large size FCB codebook when one channel is idle).

In step S30 (multi-talk) the following strategy is used.

General: Separate channels assumed, few or no common bits.

LPC encoded separately

ACB encoded separately

FCB encoded separately, no common FCB, The size of the FCB for each channel is decided using the phonetic class, also a closed loop approach with a minimum weighted SNR target is used in voiced frames to determine the final size of the FCB for voiced frames.

A technique known as generalized LPAS (see [5]) can also be used in a multi-channel LPAS coder. Briefly this technique involves pre-processing of the input signal on a frame by frame basis before actual encoding. Several possible modified signals are examined, and the one that can be encoded with the least distortion is selected as the signal to be encoded.

The description above has been primarily directed towards an encoder. The corresponding decoder would only include the synthesis part of such an encoder. Typically and encoder/decoder combination is used in a terminal that transmits/receives coded signals over a bandwidth limited communication channel. The terminal may be a radio terminal in a cellular phone or base station. Such a terminal would also include various other elements, such as an antenna, amplifier, equalizer, channel encoder/decoder, etc. However, these elements are not essential for describing the present invention and have therefor been omitted.

It will be understood by those skilled in the art that various modifications and changes may be made to the present invention without departure from the scope thereof, which is defined by the appended claims.

REFERENCES

[1] A. Gersho, "Advances in Speech and Audio Compression", Proc. of the IEEE, Vol. 82, No. 6, pp 900-918, June 1994,

[2] A. S. Spanias, "Speech Coding: A Tutorial Review", Proc. of the IEEE, Vol 82, No. 10, pp 1541-1582, October 1994.

[3] WO 00/19413 (Telefonaktiebolaget L M Ericsson).

[4] Allen Gersho et. al, "Variable rate speech coding for cellular networks", page 77-84, Speech and audio coding for wireless and network applications, Kluwer Academic Press, 1993.

[5] Bastiaan Kleijn et. al, "Generalized analysis-by-synthesis coding and its application to pitch prediction", page 337-340, In Proc. IEEE Int. Conf. Acoust., Speech and Signal Processing, 1992.

The invention claimed is:

1. A multi-channel linear predictive analysis-by-synthesis signal encoding method, comprising:

receiving an input signal on multiple channels;

detecting inter-channel correlation between the input signals on the multiple channels;

selecting an encoding mode based on said detected inter-channel correlation; and adaptively distributing bits between channel-specific fixed codebooks and a shared fixed codebook depending on said selected encoding mode.

2. The method of claim 1, wherein selectable encoding modes have a fixed gross bit-rate.

3. The method of claim 1, wherein selectable encoding modes may have a variable gross bit-rate.

4. The method of claim 1, further comprising:

determining inter-channel correlation in a time domain.

5. The method of claim 1, further comprising:

determining inter-channel correlation in a frequency domain.

6. The method of claim 1, further comprising:

using channel specific LPC filters for low inter-channel correlation; and using a shared LPC filter for high inter-channel correlation.

7. The method of claim 1, further comprising:

using channel-specific fixed codebooks for low inter-channel correlation; and using a shared fixed codebook for high inter-channel correlation.

8. The method of claim 7, further comprising:

determining individual fixed codebook size based on phonetic classification.

9. The method of claim 1, further comprising:

using channel-specific adaptive codebook lags for low inter-channel correlation; and using a shared adaptive codebook lag for high inter-channel correlation.

10. The method of claim 1, further comprising:

using inter-channel adaptive codebook lags.

11. The method of claim 1, further comprising:

weighting residual energy according to relative channel strength for low inter-channel correlation.

12. The method of claim 1, further comprising: multi-mode inter-channel parameter prediction and quantization.

13. A multi-channel linear predictive analysis-by-synthesis signal encoder, comprising electronic circuitry configured to:

receive an input signal on multiple channels;

detect inter-channel correlation between the input signals on the multiple channels;

an encoding mode based on said detected inter-channel correlation; and adaptively distribute bits between channel-specific fixed codebooks and a shared fixed codebook depending on said selected encoding mode.

14. The encoder of claim 13, the electronic circuitry further configured to determine inter-channel correlation in a time domain.

15. The encoder of claim 13, the electronic circuitry further configured to determine inter-channel correlation in a frequency domain.

16. The encoder of claim 13, wherein the electronic circuitry includes:

channel-specific LPC filters for low inter-channel correlation;

and a shared LPC filter for high inter-channel correlation.

17. The encoder of claim 13, wherein the electronic circuitry includes:

channel-specific fixed codebooks for low inter-channel correlation;

and a shared fixed codebook for high inter-channel correlation.

18. The encoder of claim 17, the electronic circuitry further configured to determine individual fixed codebook size based on phonetic classification.

19. The encoder of claim 13, wherein the electronic circuitry includes:

channel specific adaptive codebook lags for low inter-channel correlation; and a shared adaptive codebook lag for high inter-channel correlation.

20. The encoder of claim 13, wherein the electronic circuitry includes:

inter-channel adaptive codebook lags.

21. The encoder of claim 13, the electronic circuitry further configured to weigh residual energy according to relative channel strength for low inter-channel correlation.

22. The encoder of claim 13, the electronic circuitry further configured to perform multi-mode inter-channel parameter prediction and quantization.

23. A terminal including a multi-channel linear predictive analysis-by-synthesis signal encoder, comprising:

means for receiving an input signal on multiple channels;

means for detecting inter-channel correlation between the input signals on the multiple channels;

means for selecting an encoding mode based on said detected inter-channel correlation; and means for adaptively distributing bits between channel-specific fixed codebooks and a shared fixed codebook depending on said selected encoding mode.

24. The terminal of claim 23, further comprising:

means for determining inter-channel correlation in the time domain.

25. The terminal of claim 23, further comprising:

means for determining inter-channel correlation in the frequency domain.

26. The terminal of claim 23, further comprising:

channel-specific fixed codebooks for low inter-channel correlation; and a shared fixed codebook for high inter-channel correlation.

* * * * *

UNITED STATES PATENT AND TRADEMARK OFFICE

CERTIFICATE OF CORRECTION

PATENT NO. : 7,283,957 B2
APPLICATION NO. : 10/380423
DATED : October 16, 2007
INVENTOR(S) : Minde et al.

It is certified that error appears in the above-identified patent and that said Letters Patent is hereby corrected as shown below:

In the Specifications

In Column 7, Line 52, delete “resealing” and insert -- rescaling --, therefor.

Signed and Sealed this
Tenth Day of September, 2013

Teresa Stanek Rea
*Acting Director of the United States Patent and Trademark Office*